US008070245B2

(12) United States Patent
Kusunoki

(10) Patent No.: US 8,070,245 B2
(45) Date of Patent: Dec. 6, 2011

(54) INK JET RECORDING APPARATUS AND METHOD OF INK JET RECORDING

(75) Inventor: Naoki Kusunoki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 423 days.

(21) Appl. No.: 12/410,939

(22) Filed: Mar. 25, 2009

(65) Prior Publication Data

US 2009/0244159 A1 Oct. 1, 2009

(30) Foreign Application Priority Data

Mar. 26, 2008 (JP) ..... 2008-079873

(51) Int. Cl.
*B41J 29/38* (2006.01)

(52) U.S. Cl. ..... 347/5; 347/9; 347/19

(58) Field of Classification Search ..... 347/5, 9, 347/15, 19

See application file for complete search history.

(56) References Cited

U.S. PATENT DOCUMENTS 6,149,327 A 11/2000 Ward et al.
2005/0275672 A1 * 12/2005 Koshikawa ..... 347/5

FOREIGN PATENT DOCUMENTS

JP 2005-125750 A 5/2005

* cited by examiner

*Primary Examiner* — Lam S Nguyen
(74) *Attorney, Agent, or Firm* — Birch, Stewart, Kolasch & Birch, LLP

(57) ABSTRACT

A first image to be recorded on a first surface is divided into front and rear half regions. Obtained thereafter is front-side ink volume and rear-side ink volume necessary for recording these half regions on the first surface. Among these half regions, the one having more ink volume is recorded in the first place. In the event of recording the rear half region in the first place, the first image is turned upside down and recorded on the first surface of the recording paper being fed in a forward direction. Alternatively, the first image is recorded on the first surface of the recording paper being fed in a backward direction. After the ink has dried on the first surface, the recording paper is reversed back to front and fed in the forward direction, and a second image is recorded on a second surface.

10 Claims, 12 Drawing Sheets

INK JET RECORDING APPARATUS AND METHOD OF INK JET RECORDING

FIELD OF THE INVENTION

The present invention relates to an ink jet recording apparatus and a method for recording images on both sides of a recording medium by reversing the recording medium.

BACKGROUND OF THE INVENTION

There is known an ink jet recording apparatus that ejects droplets of ink from a nozzle of an inkjet head and deposits them onto a recording paper, so as to record an image represented by ink dots. There is also known a type of ink jet recording apparatus which performs duplex recording by reversing the front and rear surfaces of a recording paper. Typically, a conventional ink jet recording apparatus with duplex recording capability feeds a recording paper in a forward direction, and ejects ink droplets to the front side (first surface) of the recording paper during the feed, so as to record a first image. When the deposited ink has dried on the first surface, the recording paper is fed in a backward direction, and reversed back to front. Then, the recording paper is fed again in the forward direction, and ink droplets are ejected to the back side (second surface) of the recording paper during the feed, so as to record a second image.

A certain drying time is necessary after the first surface recording process because, if the recording paper was reversed before the deposited ink had dried and fixed completely on the first surface, the undried ink droplets would be pulled by a roller or a guide that touched the first surface, and blur the first image. This drying time also prevents the ink from transferring to the roller or the guide to smear the next recording paper.

The conventional ink jet recording apparatus uses a long drying time so that the recording paper is reversed when the deposited ink on the first surface has completely dried and fixed. However, the drying time is not changed in most cases even for an image with a few ink droplets (an image with low average density), and thus it takes a long time to complete duplex recording. An ink jet recording apparatus to solve this drawback is disclosed in U.S. Pat. No. 6,149,327. This ink jet recording apparatus measures total volume of ink droplets necessary for the first surface of a recording paper, and determines the drying time based on the measured volume.

Ink droplets dry and fix slower when deposited densely to overlap with each other than when deposited separately. The above ink jet recording apparatus is, however, unable to judge whether the ink is deposited densely or separately, and would reverse the recording paper before the ink has not dried completely on the first surface. Japanese Patent Laid-open Publication No. 2005-125750 discloses an ink jet recording apparatus to solve this drawback. This ink jet recording apparatus divides an image to be recorded on the first surface into several regions, and measures volume of ink droplets necessary for each region, and determines the drying time based on the measured volume.

Ink droplets on a recording paper start drying and fixing as soon as they are deposited. In other words, the time it takes to record an image way down to the rear end of a recording paper can be used as the drying time for the deposited ink droplets on the front end of the recording paper. Although the ink jet recording apparatus of the publication No. 2005-125750 regards the drying time for the most-ink-droplets region as the drying time for the first surface, it cannot reduce the drying time when the most-ink-droplets region lies on the rear end of a recording paper. In other words, the recording time cannot be used in full measure as the drying time.

SUMMARY OF THE INVENTION

In view of the foregoing, it is an object of the present invention to provide ink jet recording apparatus and method to reduce a total time of duplex recording by using the time it takes to record an image on a first surface of a recording paper as a drying time for the ink deposited on the first surface.

In order to achieve the above and other objects, an ink jet recording apparatus according to the present invention includes an ink volume obtainer and a record controller to control an image recording process. The ink volume obtainer divides a first image into front and rear half regions, and obtains front-side ink volume and rear-side ink volume which are the total volume of the ink droplets used for recording these regions. In recording the first image on a first surface, the record controller compares the front-side ink volume to the rear-side ink volume, and records one of the front and rear half regions having more ink volume than the other on a recording medium in the first place. When the ink on the first surface has dried, the recording medium is reversed back to front, and a second image is recorded on a second surface of the recording medium.

In a preferred embodiment of the present invention, the record controller turns the first and second images 180 degrees when the rear-side ink volume is more than the front-side ink volume, and records the images on the first and second surfaces sequentially while feeding the recording medium in a normal direction.

In another preferred embodiment of the present invention, when the rear-side ink volume is more than the front-side ink volume, the record controller once feeds the recording medium in the normal direction until it passes an ink jet head, and records the first image on the first surface while feeding the recording medium back in an opposite direction. The second image is then recorded on the second surface of the recording medium which is fed again in the normal direction.

In still another preferred embodiment of the present invention, the ink volume obtainer also obtains first ink volume and second ink volume which are the total volume of the ink droplets necessary for recording the first and second images respectively. The record controller compares the first ink volume to the second ink volume. When the second ink volume is more than the first ink volume, the record controller interchanges the first image with the second image, and records the image having less ink droplets on the second surface.

It is preferred to provide the ink jet recording apparatus with a drying time calculator that calculates time for the ink to dry on the first surface, based on the front-side ink volume and the rear-side ink volume.

A method of ink jet recording according to the present invention includes an ink volume obtaining step, a comparing step, and a recording step. In the ink volume obtaining step, the first image is divided into front and rear half regions, and front-side ink volume and rear-side ink volume necessary for recording images on these regions are obtained. In the comparing step, the front-side ink volume is compared to the rear-side ink volume. In the recording step, the region having more ink volume, between the front and rear half regions, is recorded in the first place. When the deposited ink on the first surface has dried, a second image is recorded on a second surface of the reversed recording medium.

In the recording step, according to a preferred embodiment of the present invention, when the rear-side ink volume is more than the front-side ink volume, the first image is turned 180 degrees, and recorded on the first surface of the recording medium that is fed in a normal direction. The recording medium is then reversed back to front, and fed back in an opposite direction. The second image is turned 180 degrees, and recorded on the second surface of the recording medium during the feed.

In another preferred embodiment of the present invention, in the recording step, when the rear-side ink volume is more than the front-side ink volume, the recording medium is once fed in a normal direction to pass an ink jet head. Then, the recording medium is fed in an opposite direction to the normal direction. The first image is recorded on the first surface during the feed of the recording medium. After reversed, the recording medium is fed in the normal direction, and the second image is recorded on the second surface during the feed.

In still another preferred embodiment of the present invention, prior to the ink volume obtaining step, a first ink volume and a second ink volume are obtained and compared. The first ink volume and the second ink volume are the total volume of the ink droplets used for recording the first and second images. When the first ink volume is more than the second ink volume, the first and second images are interchanged.

It is preferred to calculate time for the ink to dry on the first surface, based on the front-side ink volume and the rear-side ink volume.

According to the present invention, one of the front and rear half regions of the first image having more ink volume is recorded in the first place. It is therefore possible to use the recording time for the later-recorded region as the drying time for the firstly-recorded region. This leads to reduce the drying time from the completion of the first image recording to the reversing of the recording medium, and thus reduce the time for duplex recording.

In recording the rear half region in the first place while feeding the recording medium in the normal direction, the first and second images are turned around. This prevents the first and second images from facing different directions on the first and second surfaces.

In recording the rear half region in the first place, the first image is recorded while the recording medium is fed in the opposite direction. This enables recording the first image in a proper orientation on a standard paper that requires an image to be recorded in a certain orientation.

The first and second images are interchanged, according to the ink volume for the first and second images, so that the first image always has less ink volume. It is therefore possible to further reduce the drying time for the deposited ink on the first surface.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS

Figure 1:
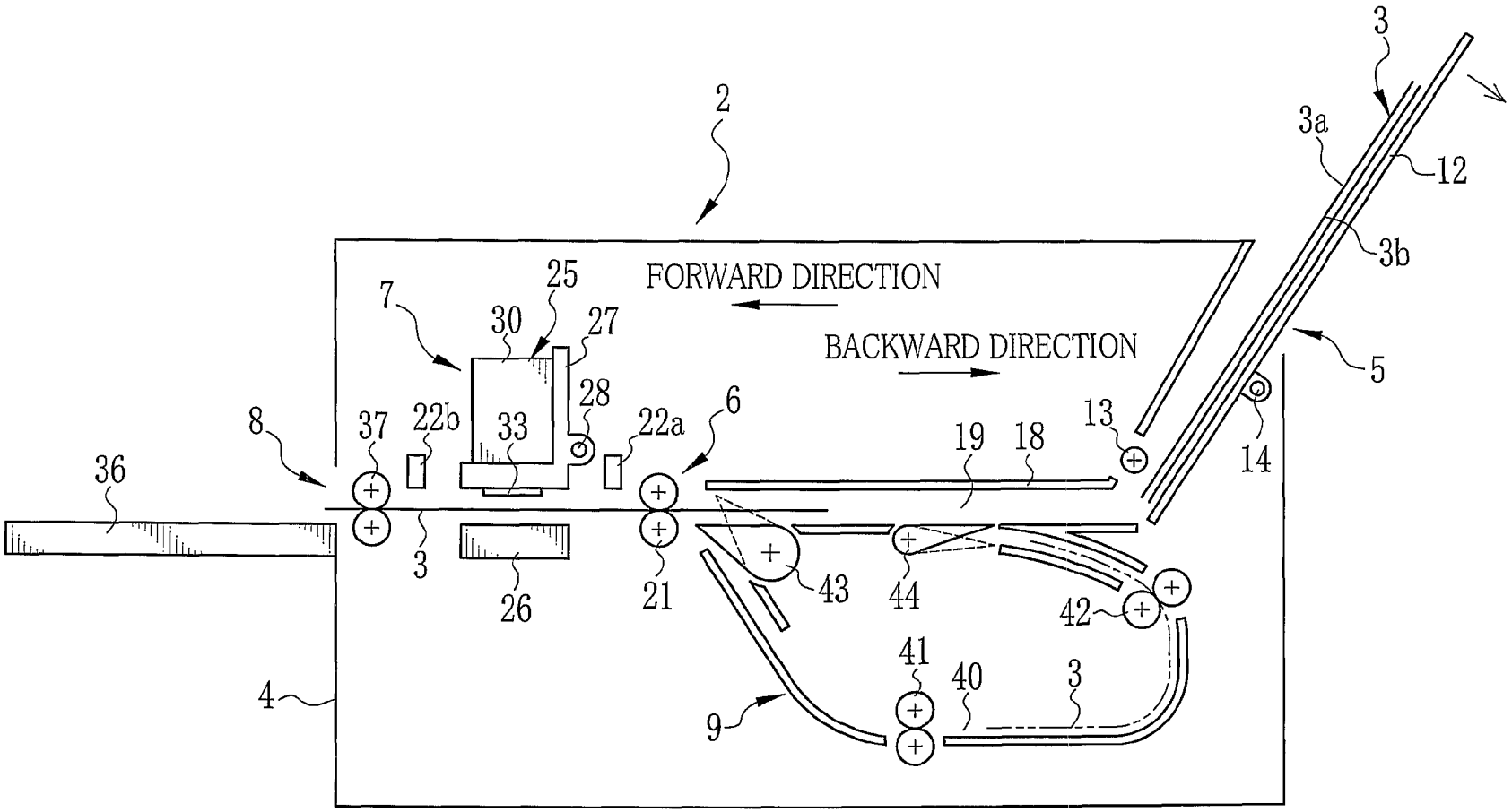
FIG. 1 is a cross sectional view schematically illustrating the configuration of an ink jet recording apparatus according to the present invention.

Referring to FIG. 1, an ink jet recording apparatus 2 provides a duplex recording function to record images on a first surface 3*a* and a second surface 3*b* of a recording paper 3. The ink jet recording apparatus 2 has a boxy case 4 that holds a paper supply section 5, a conveyance section 6, a recording section 7, a paper discharge section 8 and a paper reversing section 9.

The paper supply section 5, disposed on a right side of the case 4, includes a paper supply tray 12 and a supply roller 13. The paper supply tray 12 is a plate-like component sloping down to the case 4, and contains the recording papers 3 with the second surfaces 3*b* facing downward. Rotatably supported on a rotary shaft 14, the paper supply tray 12 is swung by a feed motor 15 (see, FIG. 2) between a standby position and a paper feed position. The supply roller 13 is arranged to face a lower end (front end) of the first surface 3*a* of the recording paper 3 in the paper supply tray 12. In feeding the recording paper 3 to the recording section 7, the feed motor 15 rotates the supply roller 13 clockwise.

While the paper supply tray 12 stays in the standby position as shown in FIG. 1, the recording paper 3 in the paper supply tray 12 is away from the supply roller 13. When the paper supply tray 12 moves clockwise to the paper feed position, the recording paper 3 in the paper supply tray 12 touches the supply roller 13. As the supply roller 13 starts rotating, the recording paper 3 is fed to the conveyance section 6, with the first surface 3*a* facing upward. Between the paper supply tray 12 and the conveyance section 6 stretches a paper path 19 formed of a guide member 18.

The conveyance section 6 includes a feed roller pair 21 and two paper edge sensors 22*a*, 22*b*. The feed roller pair 21 is composed of mutually-pressing two rollers, one of which is rotated by the feed motor 15. The feed roller pair 21 nips the recording paper 3 coming from the paper supply tray 12, and feeds it in a normal (forward) direction or an opposite (backward) direction. The paper edge sensors 22*a*, 22*b* are, for example, reflection type optical sensors, and detect the front and rear edges of the recording paper 3. The paper edge sensor 22*a* detects the recording paper 3 during the forward feed, while the paper edge sensor 22*b* detects the recording paper 3 during the backward feed.

The recording section 7 includes a head unit 25 and a platen 26. The head unit 25 has a carriage 27. The carriage 27 is supported on a guide rod 28 extending in a main scanning direction (vertical direction to the surface of FIG. 1) orthogonal to a sub scanning direction (horizontal direction in FIG. 1), and moved in the main scanning direction by a carriage motor 29 (see, FIG. 2). Attached on the carriage 27 is a plurality of ink cartridges 30 that contain ink of different colors, such as yellow (Y), magenta (M), cyan (C) and black (K).

Appeared on the bottom of the carriage 27 is a plurality (for example, four) of ink jet heads 33 arranged in the main scanning direction. These ink jet heads 33 correspond to the ink cartridges 30 of Y, M, C and K respectively. Each ink jet head 33 has a plurality of downward-pointing nozzles to eject droplets of ink.

The platen 26 is placed below the head unit 25. As an image is recorded on the recording paper 3 with the ink droplets from the head unit 25, the platen 26 supports the back side of the recording paper 3.

The paper discharge section 8 includes a paper discharge tray 36 and a discharge roller pair 37. The paper discharge tray 36 receives the already-recorded papers 3. The paper discharge tray 36 also functions as a switch-back section that temporarily receives a part of the recording paper 3 when the recording paper 3 fed all the way down in the forward direction is sent back to the recording section 7.

The discharge roller pair 37 is composed of mutually-pressing two rollers, one of which is rotated by the feed motor 15. The discharge roller pair 37 nips the recording paper 3 having passed through the recording section 7, and discharges it to the paper discharge tray 36. In the event of reversing the recording paper 3 back to front, the discharge roller pair 37, together with feed roller pair 21, feeds the recording paper 3 to the paper reversing section 9.

The paper reversing section 9 includes a loop paper path 40, two of reverse roller pairs 41, 42, a first changeover guide 43 and a second changeover guide 44. The loop paper path 40 is formed of the guide member 18, and disposed underneath the paper path 19. The loop paper path 40 is connected to the paper path 19. The reverse roller pair 41 is composed of mutually-pressing two rollers, one of which is rotated by the feed motor 15. The reverse roller pair 42 has the same configuration.

The first and second changeover guides 43, 44 are rotated by the feed motor 15 between a paper feed position and a paper reverse position. In the paper feed position shown by solid lines in the drawing, the first and second changeover guides 43, 44 close the loop paper path 40, allowing the paper feed. In the paper reverse position shown by dashed lines, by contrast, the first and second changeover guides 43, 44 open the loop paper path 40, and the first changeover guide 43 guides the rear edge (leading edge in the backward direction) of the recording paper 3 into the loop paper path 40. In the paper reverse position, the second changeover guide 44 guides the recording paper 3 having passed through the loop paper path 40 back into the paper path 19. Returning from the paper reversing section 9 to the paper path 19, the recording paper 3 has been reversed back to front, with the second surface 3*b* facing upward and the first surface 3*a* facing downward.

The feed motor 15 rotates clockwise or counter-clockwise the supply roller 13, the feed roller pair 21, the discharge roller pair 37 and the reverse roller pairs 41, 42. The feed motor is connected to the paper supply tray 12, the first changeover guide 43 and the second changeover guide 44 by way of a power transmission mechanism (not shown) that moves them at appropriate timing.

Figure 2:
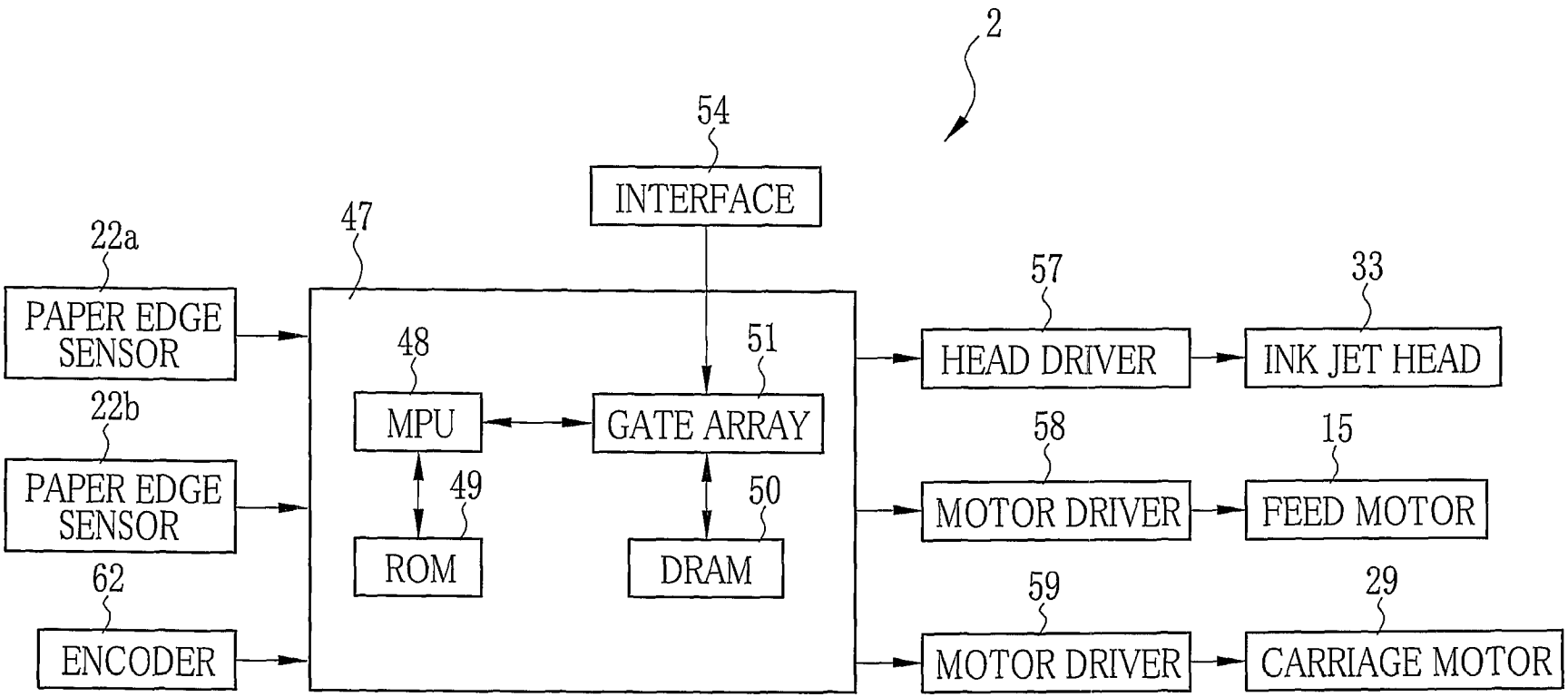
FIG. 2 is a block diagram of the ink jet recording apparatus.

As shown in FIG. 2, the ink jet recording apparatus 2 has a control unit 47 for the recording operation. The control unit 47 includes an MPU 48, a ROM 49, a DRAM 50 and a gate array 51. The MPU 48 performs various computations, judgments, controls and other processing necessary for the image recording to the recording paper 3. The ROM 49 stores the programs run by the MPU 48. The DRAM 50 temporarily stores record data carrying an image to be recorded, and also provides a work area for the MPU 48 to perform the computations.

The control unit 47 is connected to an interface 54, and transmits and receives signals from an external device, such as a host computer (not shown). The signals that enter through the interface 54 are transmitted to the MPU 48 and the DRAM 50 through the gate array 51.

The control unit 47 is connected to a head driver 57 for driving the nozzles of the ink jet head 33, a motor driver 58 for driving the feed motor 15, and a motor driver 59 for driving the carriage motor 29. The feed motor 15 and the carriage motor 29 are pulse motors, for example. The control unit 47 is also connected to the paper edge sensors 22*a*, 22*b* and an encoder 62 that detects the position of the carriage 27 in the main scanning direction.

Figure 3:
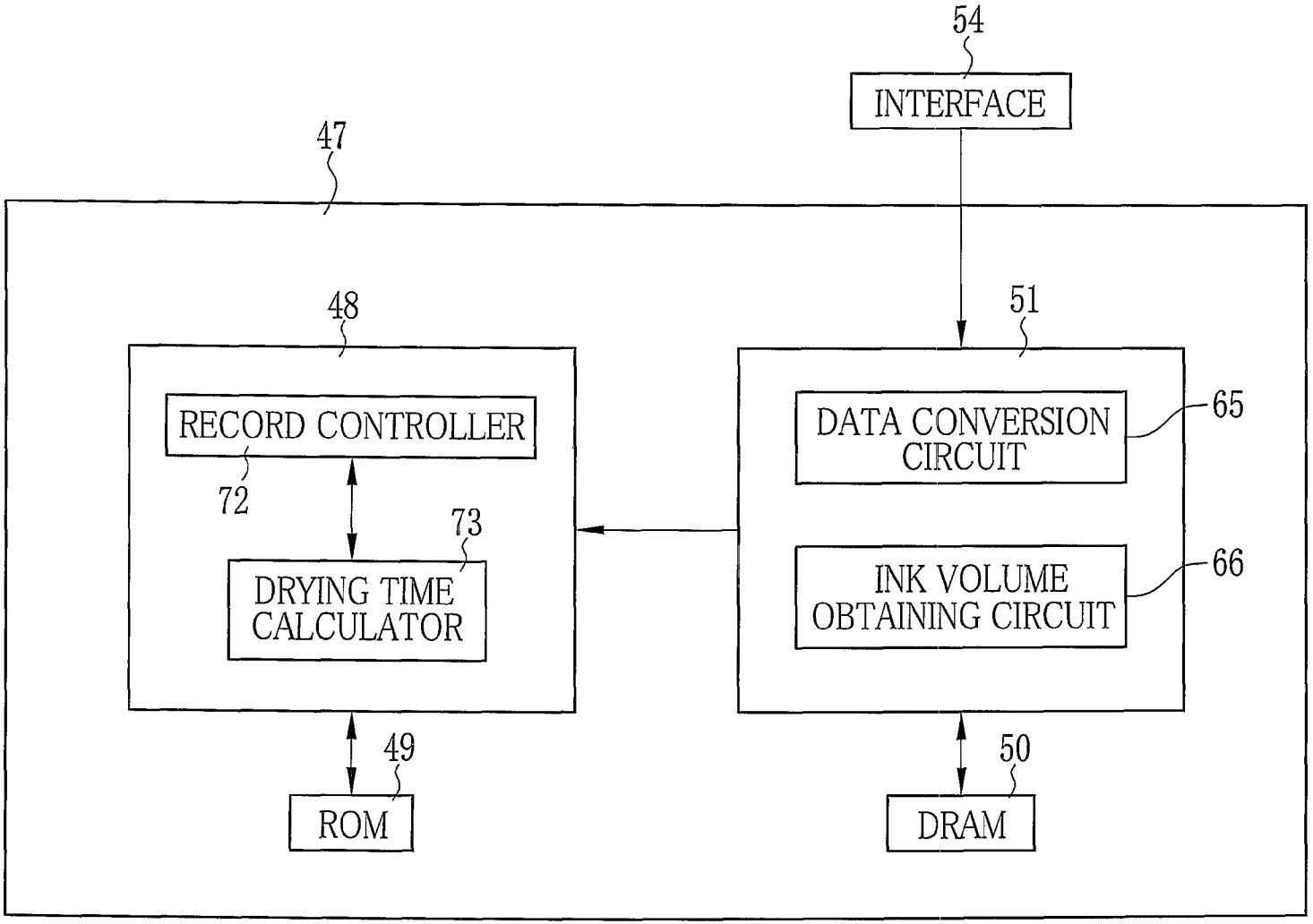
FIG. 3 is a functional block diagram of a control section.

As shown in FIG. 3, the gate array 51 includes a data conversion circuit 65 and an ink volume obtaining circuit 66. Through the interface 54, the gate array 51 receives the record data. The data conversion circuit 65 converts the record data into separate drive data of Y, M, C and K. This drive data is used for driving each of the Y, M, C and K ink jet heads 33 at an ink deposit position on the recording paper 3.

Figure 4:
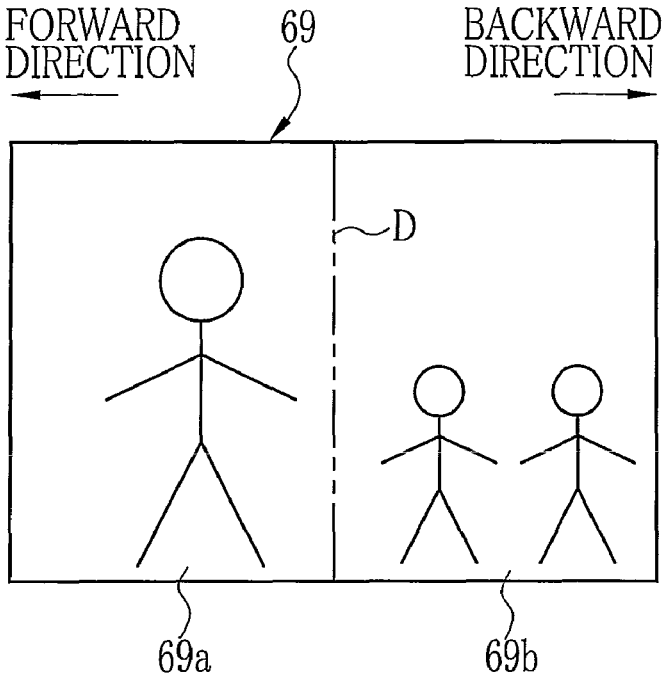
FIG. 4 is an explanatory view illustrating an example of a first image.

In FIG. 4, the left side and the right side of the drawing correspond to the forward and the backward directions of the paper feed path respectively. Upon receiving the data of a first image 69 (first record data) to be recorded on the first surface 3*a* through the interface 54, the ink volume obtaining circuit 66 divides the first image 69 into two even regions, a front half region 69*a* and a rear half region 69*b*, along the forward direction. A chain double-dashed line D is a virtual line provided to indicate a border of the front and rear half regions 69*a*, 69*b* for the sake of better understanding, and is not recorded on the first surface 3*a*.

From the Y, M, C and K drive data, the ink volume obtaining circuit 66 obtains front-side ink volume A and rear-side ink volume B that represent the total volume of ink droplets necessary for recording the front half region 69*a* and a the rear half region 69*b* respectively.

When the tone of an image is expressed by the number of ink dots, the ink volume is obtained by counting the number of ink dots in each of the half regions 69*a*, 69*b*. When the tone of an image is expressed by the number of dots and the size of the dots, the ink volume is obtained by adding up all the ink dots after multiplying every ink dot by a coefficient predetermined for each size of dot. More simply, the ink volume is obtained by adding up all the drive data.

The MPU 48 runs the program retrieved from the ROM 49, and functions as a record controller 72 and a drying time calculator 73 (see, FIG. 3). The record controller 72 compares the front-side ink volume A to the rear-side ink volume B, both obtained by the ink volume obtaining circuit 66. Based on the comparison result of the ink volume A and B, the record controller 72 selects one of a first duplex recording process and a second duplex recording process.

The first duplex recording process is selected when the front-side ink volume A is more than the rear-side ink volume B. In the first duplex recording process, the front half region 69*a* of the first image 69 is recorded in the first place. The second duplex recording process is selected when the front-side ink volume A is less than the rear-side ink volume B. In the second duplex recording process, the rear half region 69*b* is recorded in the first place.

The drying time calculator 73 calculates a time interval for the paper reversing section 9 to reverse the recording paper 3 back to front after the image has been recorded on the first surface 3*a* of the recording paper 3. This time interval, or drying time, is calculated based on the front-side ink volume A and the rear-side ink volume B. The drying time is also calculated to include the recording time as a part of it.

Figure 5:
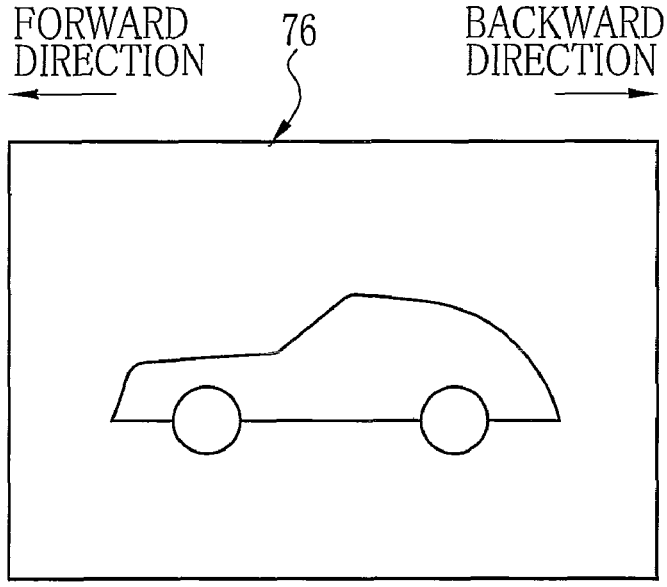
FIG. 5 is an explanatory view illustrating an example of a second image.

FIG. 5 shows an example of a second image 76 to be recorded on the second surface 3*b* of the recording paper 3. FIG. 6A to FIG. 6C and FIG. 7A to FIG. 7C illustrate the steps of the first and second duplex recording processes to record the first and second images 69, 76 onto the first and second surfaces 3*a*, 3*b* of the recording paper 3. With reference to a flowchart of FIG. 8, the operation of the ink jet recording apparatus 2 is now explained.

As the first record data enters through the interface 54, the gate array 51 stores it in the DRAM 50. The data conversion circuit 65 retrieves the first record data from the DRAM 50, and converts it into the Y, M, C and K drive data, and then stores them in the DRAM 50.

The ink volume obtaining circuit 66 divides the Y, M, C and K drive data for the first image 69 into the front half region 69*a* and the rear half region 69*b*, and obtains the front-side ink volume A for the front half region 69*a* and the rear-side ink volume B for the rear half region 69*b*. The front-side ink volume A and the rear-side ink volume B are stored in the DRAM 50.

The record controller 72 compares the front-side ink volume A to the rear-side ink volume B, and selects one of the first and second duplex recording processes. When the front-side ink volume A is more than the rear-side ink volume B, the record controller 72 selects the first duplex recording process. In contrast, when the front-side ink volume A is less than the rear-side ink volume B, the record controller 72 selects the second duplex recording process.

Figure 9:
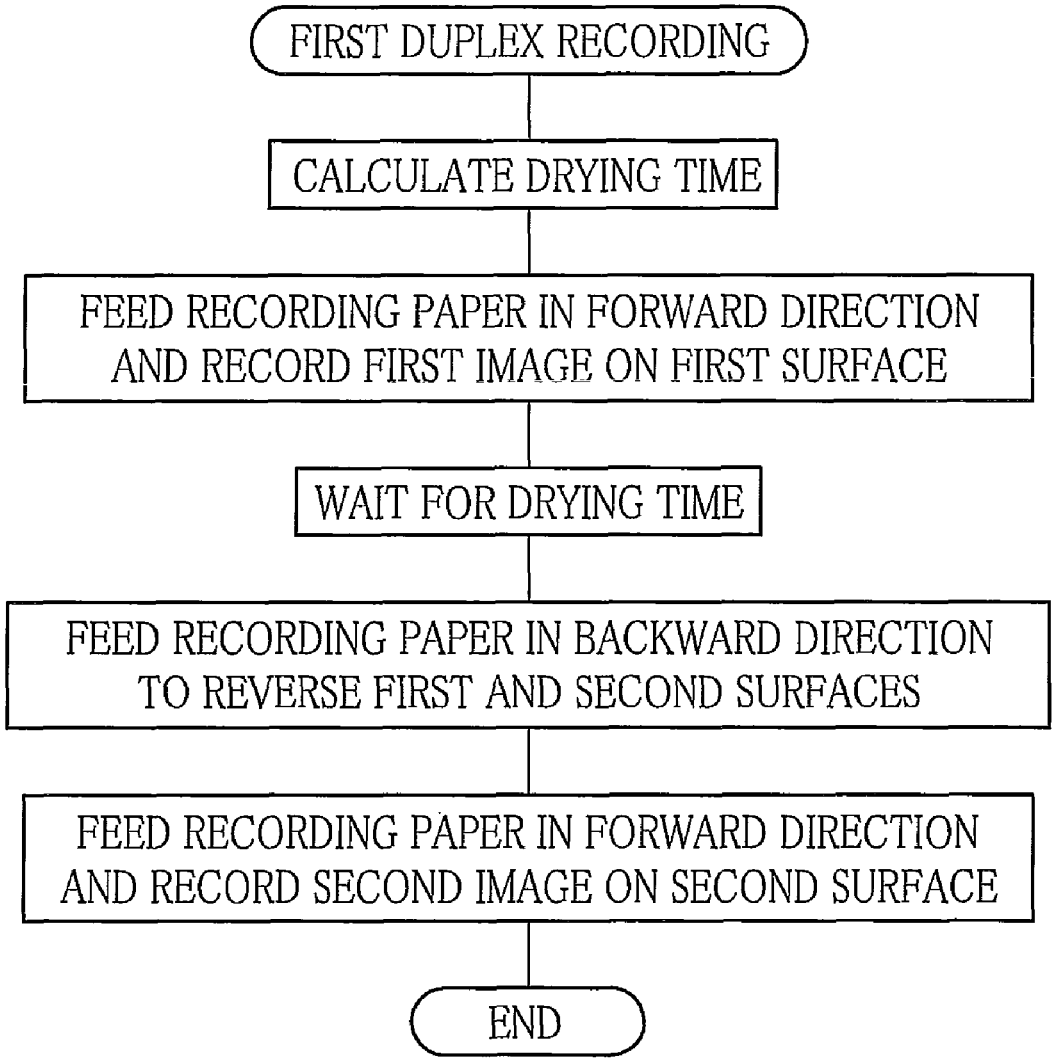
FIG. 9 is a flowchart of the first duplex recording process.

Next, with reference to a flowchart of FIG. 9, the first duplex recording process is explained. When the first duplex recording process is selected, the drying time calculator 73 calculates the drying time, based on the front-side ink volume A and the rear-side ink volume B. This drying time is calculated to include the recording time for the first image 69 as a part of the drying time. Basically, regional drying time is firstly calculated for each of the front and rear half regions 69*a*, 69*b*, based on the ink volume. In this calculation, the regional drying time for the firstly-recorded half region is the value of the regional drying time according to the ink volume minus the recording time for the later-recorded half region. Then, the maximum value of the regional drying time is determined as the drying time. The calculated drying time is stored in the DRAM 50.

The control unit 47 operates the motor driver 58 to rotate the feed motor 15, and moves the paper supply tray 12 to the paper feed position. The recording paper 3 on the paper supply tray 12 touches the supply roller 13. Rotating clockwise, the supply roller 13 pushes the uppermost recording paper 3 to the paper path 19.

The recording paper 3 is fed in the forward direction on the paper path 19 to reach the feed roller pair 21, which nips the front end of the recording paper 3. The feed roller pair 21 feeds the recording paper 3 further in the forward direction. The paper edge sensor 22*a* detects the front end of the recording paper 3, and transmits a detection signal to the control unit 47. Receiving the detection signal, the control unit 47 controls the feeding amount of the recording paper 3 based on the rotation rate of the feed motor 15.

The control unit 47 operates the feed motor 15 to feed the recording paper 3 in the forward direction by a predetermined distance at a time. When the recording paper 3 stops moving, the control unit 47 operates the motor driver 59 to rotate the carriage motor 29, and moves the carriage 27 in the main scanning direction. Using the encoder 62, the control unit 47 detects the position of the carriage 27. The gate array 51 retrieves the Y, M, C and K drive data from the DRAM 50 according to the position of the carriage 27, and sends the drive data to the head driver 57. Based on the drive data, the head driver 57 drives each ink jet head 33 to eject the ink of Y, M, C and K to the first surface 3*a*. By the movement of the carriage 27, a line of the image is recorded. Then, as the feed motor 15 feeds the recording paper 3 by the predetermined distance, the carriage 27 moves back while ejecting the ink droplets, and record the next line of the image.

Figure 6A:
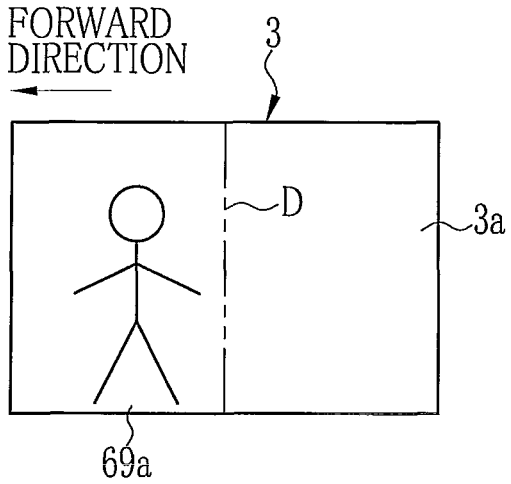
FIG. 6A to FIG. 6C are explanatory views illustrating a procedure of a first duplex recording process.
Figure 6B:
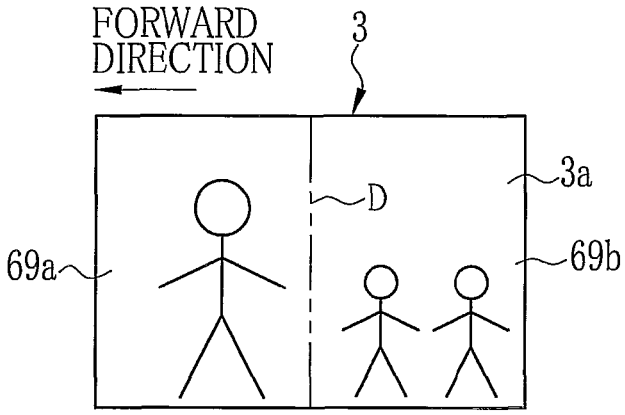

Through the intermittent feed of the recording paper 3, and the movement of the carriage and the drive of the ink jet heads 33 in the interval of the feed, the first image 69 is recorded line by line on the first surface 3*a* of the recording paper 3. As shown in FIG. 6A, the front half region 69*a* of the first image 69 is recorded first on the first surface 3*a*. Then, as shown in FIG. 6B, the rear half region 69*b* of the first image 69 is recorded on the first surface 3*a*. The first image 69 is thereby recorded in a default orientation, where the left and right sides of the first image 69 correspond to the forward and backward directions of the recording paper 3.

After the recording process of the first image 69, the recording paper 3 is once fed to the paper discharge tray 36 by the discharge roller pair 37. The recording paper 3 is left on the paper discharge tray 36 until the drying time retrieved from the DRAM 50 has passed, so as to dry the ink on the first surface 3*a*. Nonetheless, this drying process can minimize loss of time because the drying time is calculated according to the ink volume for the first surface 3*a*. Additionally, the recording time for the rear half region 69*b* is calculated as a part of the drying time for the front half region 69*a* that has more ink volume, and therefore the drying time is reduced when compared to the case to print the rear half region 69*b* that has less ink volume in the first place. During the drying time, the discharge roller pair 37 keeps nipping the recording paper 3.

After the lapse of the drying time, the control unit 47 rotates the feed motor 15 in the reverse direction, and feeds the recording paper 3 in the backward direction. At this time, the control unit 47 moves the first and second changeover guides 43, 44 to the paper reverse positions shown by the dashed lines. The recording paper 3 going backward is guided by the first changeover guide 43 into the loop paper path 40, and fed by the reverse roller pairs 41, 42. The recording paper 3 is then guided by the second changeover guide 44 to return to the paper path 19. In this stage, the recording paper 3 has been reversed back to front by the paper reversing section 9, and the second surface 3*b* faces upward in the paper path 19.

Figure 6C:
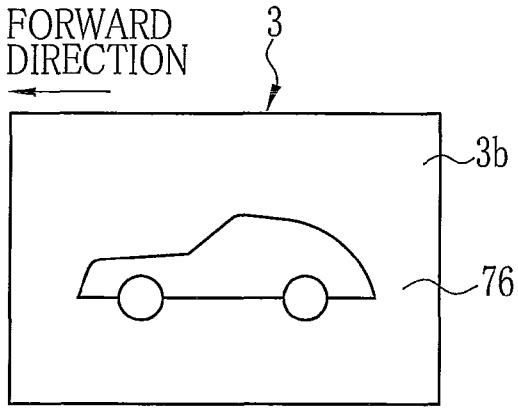

Similar to the recording process of the first image 69 to the first surface 3*a*, the control unit 47 retrieves and converts record data for the second image (second record data). Controlling the conveyance section 6 to feed the recording paper 3 in the forward direction, the control unit 47 operates the recording section 7 to record the second image 76 on the second surface 3*b*. As shown in FIG. 6C, the second image 76 is recorded on the recording paper 3 to have the same vertical direction as the first image 69. The recording paper 3 having the second image 76 is discharged to the paper discharge tray 36.

Figure 10:
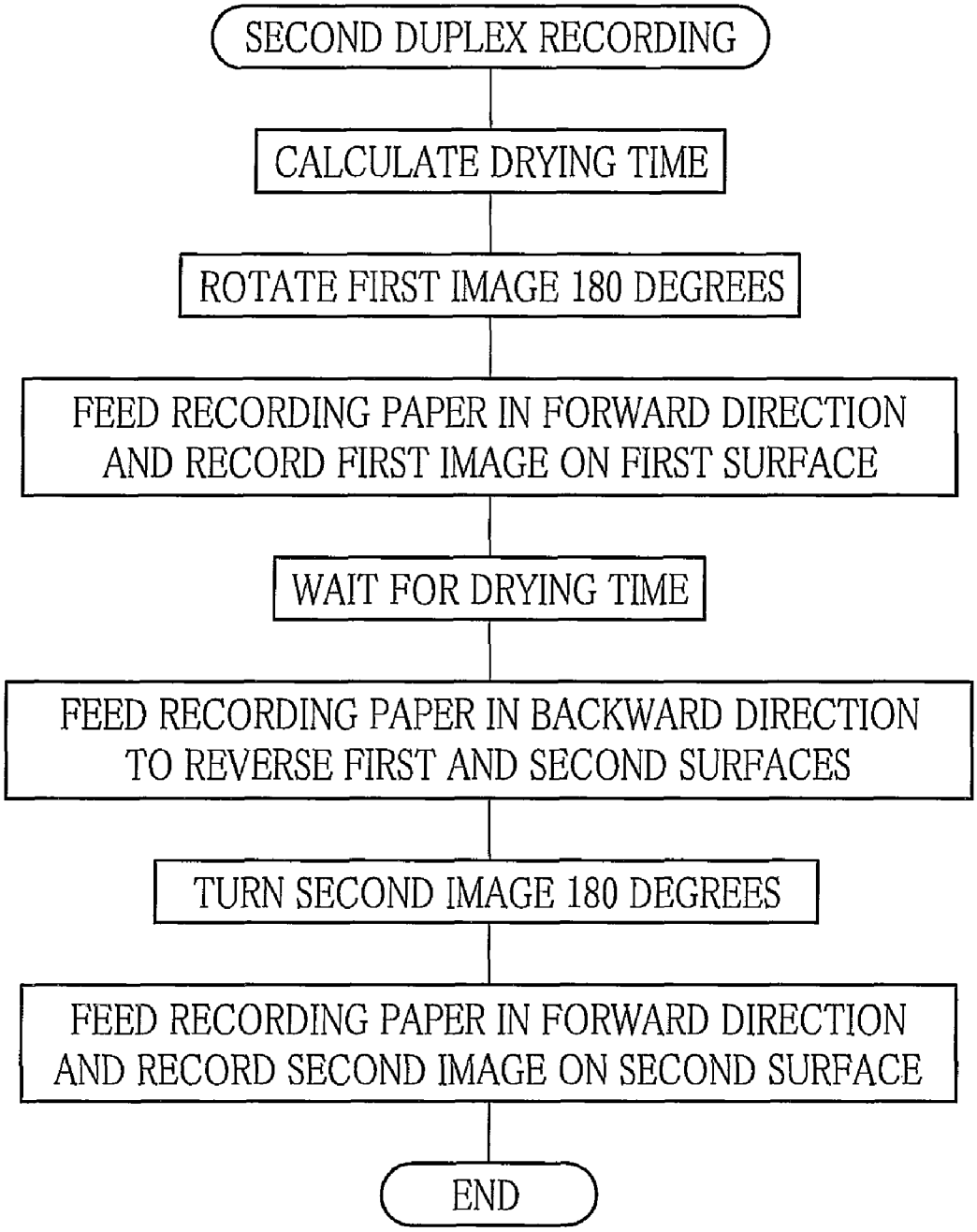
FIG. 10 is a flowchart of the second duplex recording process.

Next, with reference to a flowchart of FIG. 10, the second duplex recording process is explained. When the second duplex recording process is selected, the drying time calculator 73 calculates the drying time in the same manner as the first duplex recording process, and stores it in the DRAM 50.

The control unit 47 turns the first image 69 to be recorded on the first surface 3*a* by 180 degrees. This may be accomplished by turning the Y, M, C and K drive data, or by turning the first image 69 and then converting it into the Y, M, C and K drive data. In the former case, the drive data is retrieved from the last line from the DRAM 50. In the latter case, the first record data is written from the last line in the DRAM 50.

Figure 7A:
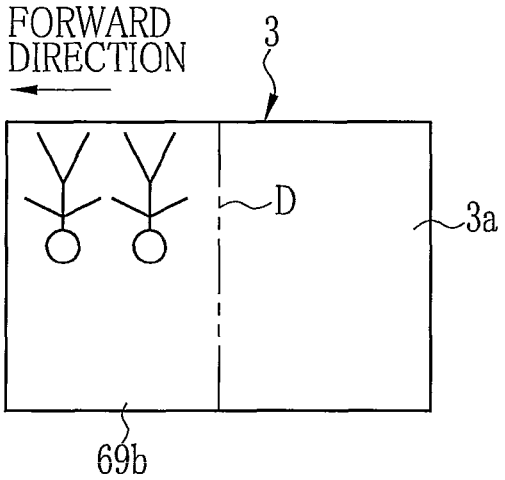
FIG. 7A to FIG. 7C are explanatory views illustrating a procedure of a second duplex recording process.
Figure 7B:
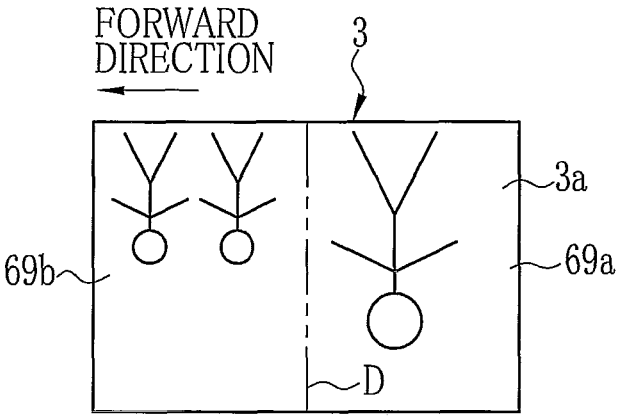
Figure 8:
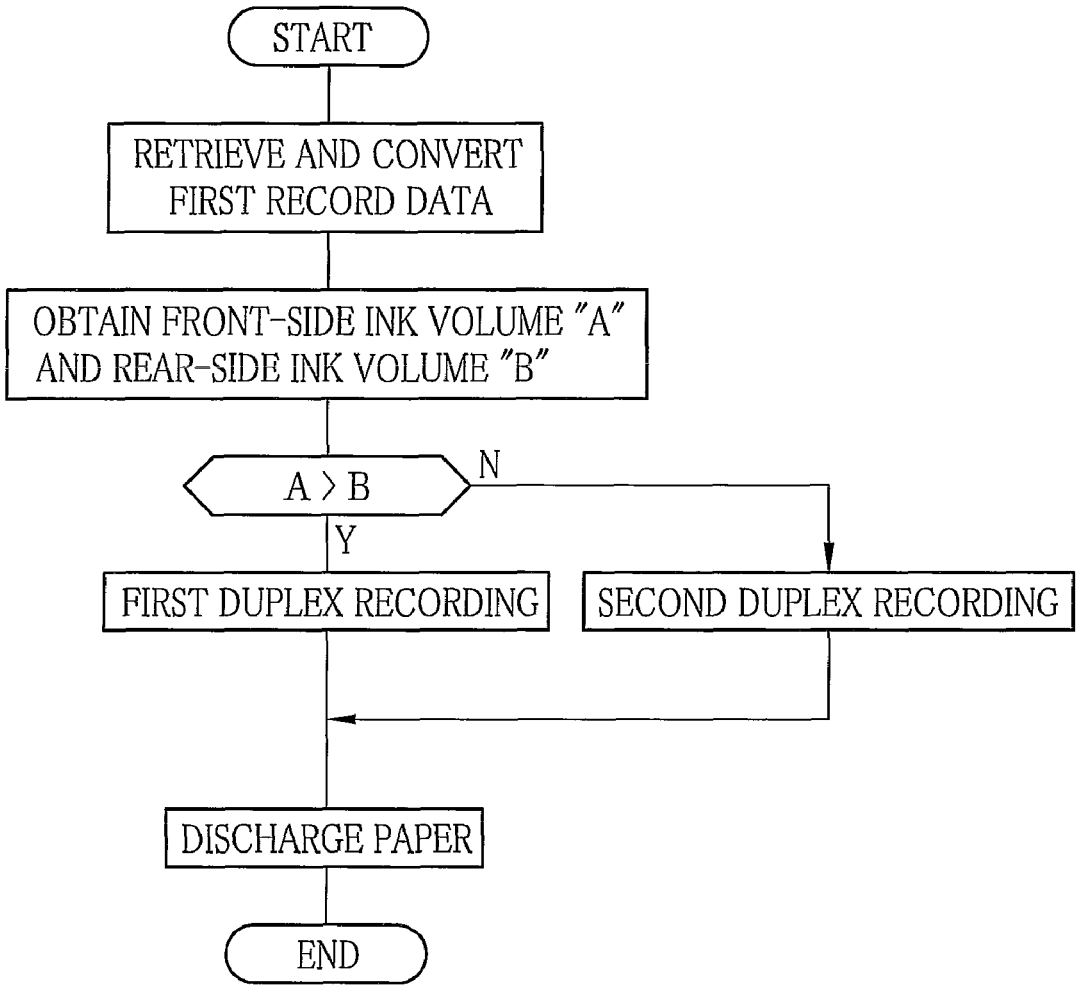
FIG. 8 is a flowchart of duplex recording.

Similar to the first duplex recording process, the control unit 47 records the first image 69 on the first surface 3*a* while feeding the recording paper 3 in the forward direction. As shown in FIG. 7A, in this case, the rear half region 69*b* of the first image 69 is recorded upside down to the first surface 3*a* in the first place. Then, as shown in FIG. 7B, the front half region 69*a* is recorded on the first surface 3*a*. As a result, the first image 69 is recorded upside down (180-degree rotation) on the recording paper 3.

After the lapse of the drying time, the control unit 47 feeds the recording paper 3 in the backward direction to the paper reversing section 9, where the recording paper 3 is reversed back to front. Similar to the first duplex recording process, the drying time in the second duplex recording process is also calculated, based on the ink volume, to include the recording time as a part of it. This leads to minimize loss of time, and reduces the total recording time shorter than the conventional ink jet recording apparatus.

Figure 7C:
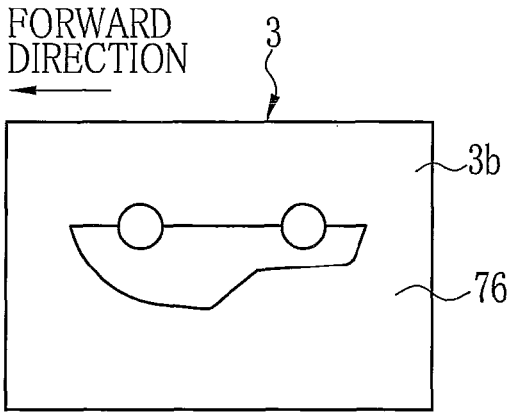

Similar to the first duplex recording process, after the reversing of the recording paper 3, the control unit 47 feeds the recording paper 3 in the forward direction, and records the second image 46 upside down to the second surface 3*b*. As shown in FIG. 7C, the second image 76 on the recording paper 3 to has the same vertical direction as the first image 69. The recording paper 3 is finally discharged to the paper discharge tray 36.

As described, both in the first and second duplex recording processes, the first image 69 is recorded from one of the regions having more ink volume than the other. This leads to reduce the drying time, and shorten the total time of duplex recording.

Some of the recording papers are strict about the direction of recording. For example, postcards, a type of standard paper, require a mailing address to be recorded in a certain direction on the front side, and an image on the back side to be recorded in the same direction as the mailing address. The present invention is also effective to such standard papers strict about the recording direction. Now, the duplex recording to the standard papers is explained.

This second embodiment is quite similar in function to the above first embodiment. Namely, the ink volume obtaining circuit 66 divides the first image 69 into the front half region 69*a* and the rear half region 69*b*, and obtains the front-side ink volume A and the rear-side ink volume B. Then, the record controller 72 compares the front-side ink volume A to the rear-side ink volume B, and selects one of the first and second duplex recording processes. The first duplex recording process is selected when the front-side ink volume A is more than the rear-side ink volume B, and the second duplex recording process is selected when the front-side ink volume A is less than the rear-side ink volume B.

The first duplex recording process of this embodiment is the same as that of the first embodiment shown in FIG. 9, and the detailed explanation thereof is omitted.

Figure 11:
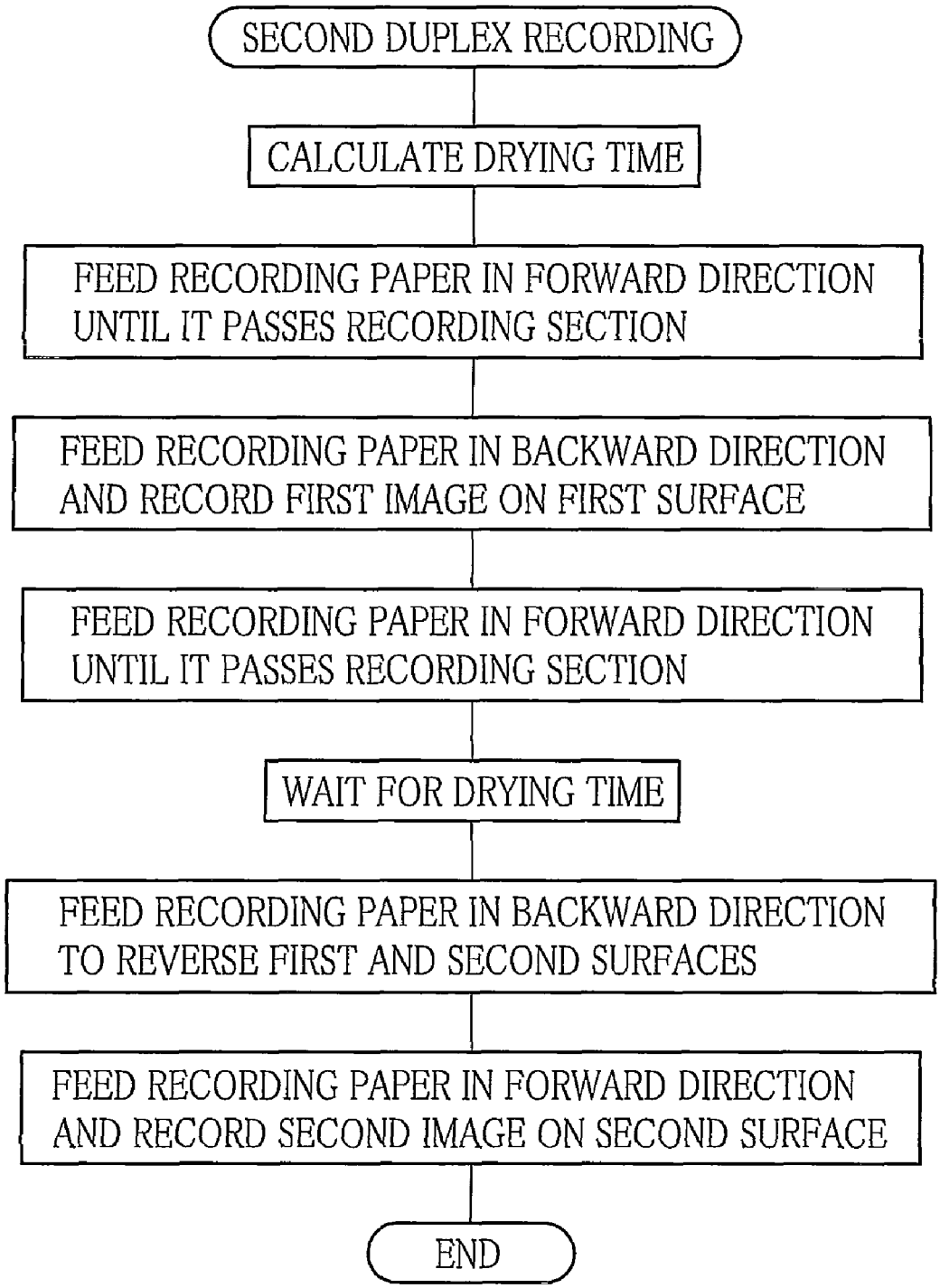
FIG. 11 a flowchart of a second duplex recording process according to another embodiment of the present invention.

As shown in FIG. 11, in the second duplex recording process of this embodiment, the control unit 47 feeds the recording paper 3, out of the paper supply section 5, in the forward direction with the feed roller pair 21, and let it pass the recording section 7, without printing an image, to the paper discharge tray 36.

The control unit 47 operates the discharge roller pair 37 and the feed roller pair 21 to feed the recording paper 3 in the backward direction. During the feed, the paper edge sensor 22*b* detects the leading edge (right-hand edge in FIG. 12) of the recording paper 3. In response to the detection of the recording paper 3, the control unit 47 detects the feeding amount of the recording paper 3 based on the rotation rate of the feed motor 15. The recording section 7 records the first image 69 on the first surface 3*a* of the recording paper 3 fed in the backward direction. In this case, the drive data in the DRAM 50 is retrieved from the last line to the first line.

Figure 12A:
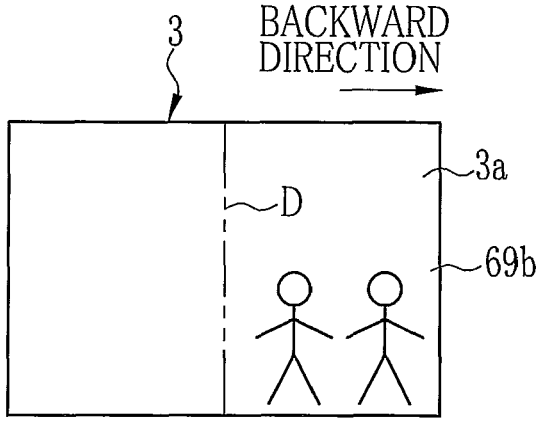
FIG. 12A to FIG. 12C are explanatory views illustrating a procedure of the second duplex recording process according to another embodiment of the present invention.
Figure 12B:
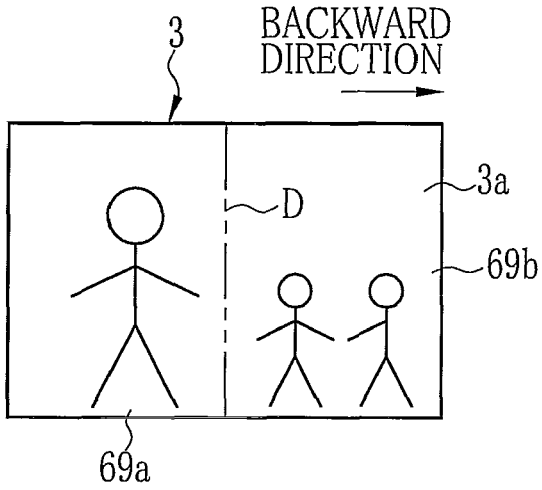

As shown in FIG. 12A, the rear half region 69*b* of the first image 69 is recorded in the first place. Then, as shown in FIG. 12B, the front half region 69*a* is recorded. During the backward feed of the recording paper 3, the first and second changeover guides 43, 44 are both set in the paper feed positions. Therefore, the recording paper 3 is not guided to the paper reversing section 9, but fed straight along the guide member 18. This prevents the ink on the first surface 3*a* from sticking on the components of the paper reversing section 9.

Upon completion of the printing process for the first image 69, the control unit 47 feeds the recording paper 3 back in the forward direction to the paper discharge tray 36, and waits for the drying time. After the lapse of the drying time, the control unit 47 feeds the recording paper 3 in the backward direction again. In this backward feed, the first and second changeover guides 43, 44 are set in the paper reverse positions to guide the recording paper 3 into the paper reversing section 9. The recording paper 3 is reversed back to front in the paper reversing section 9, and fed back to the paper path 19 with the second surface 3*b* facing upward.

Figure 12C:
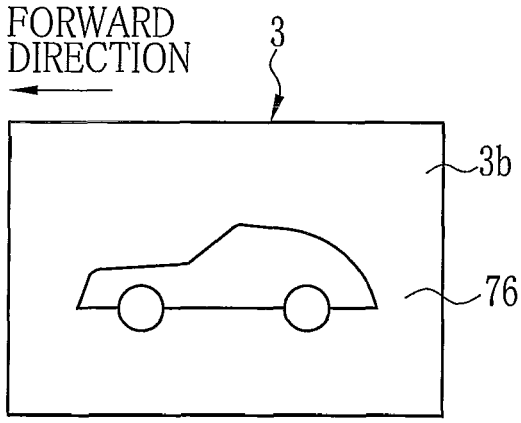

Similar to the first duplex recording process of the first embodiment, the control unit 47 records the second image 76 on the second surface 3*b* while feeding the recording paper 3 in the forward direction. As shown in FIG. 12C, the second image 76 is recorded in the original orientation on the second surface 3*b*, and has the same vertical direction as the first image 69.

As described, the second duplex recording process of this embodiment is able to record the first image 69 from the rear-end side in the forward direction, without turning the first image 69 upside down. This enables setting an appropriately reduced drying time for the ink on the first surface, even with standard papers. Although this embodiment requires additional feeding time, before and after the recording of the first image 69, this feeding time is much shorter than the drying time for an ink-intensive image, and thus the total time for the duplex recording can still be reduced.

While the above embodiments are both directed to record the first image 69 and the second image 76 on the first and second surfaces 3*a*, 3*b* respectively, it may be possible to interchange the images to be recorded on the first and second surfaces 3*a*, 3*b*, depending on the ink volume for the first image 69 and the second image 76, so that the first image 69 always has less ink volume. Hereafter embodies this case.

Figure 13:
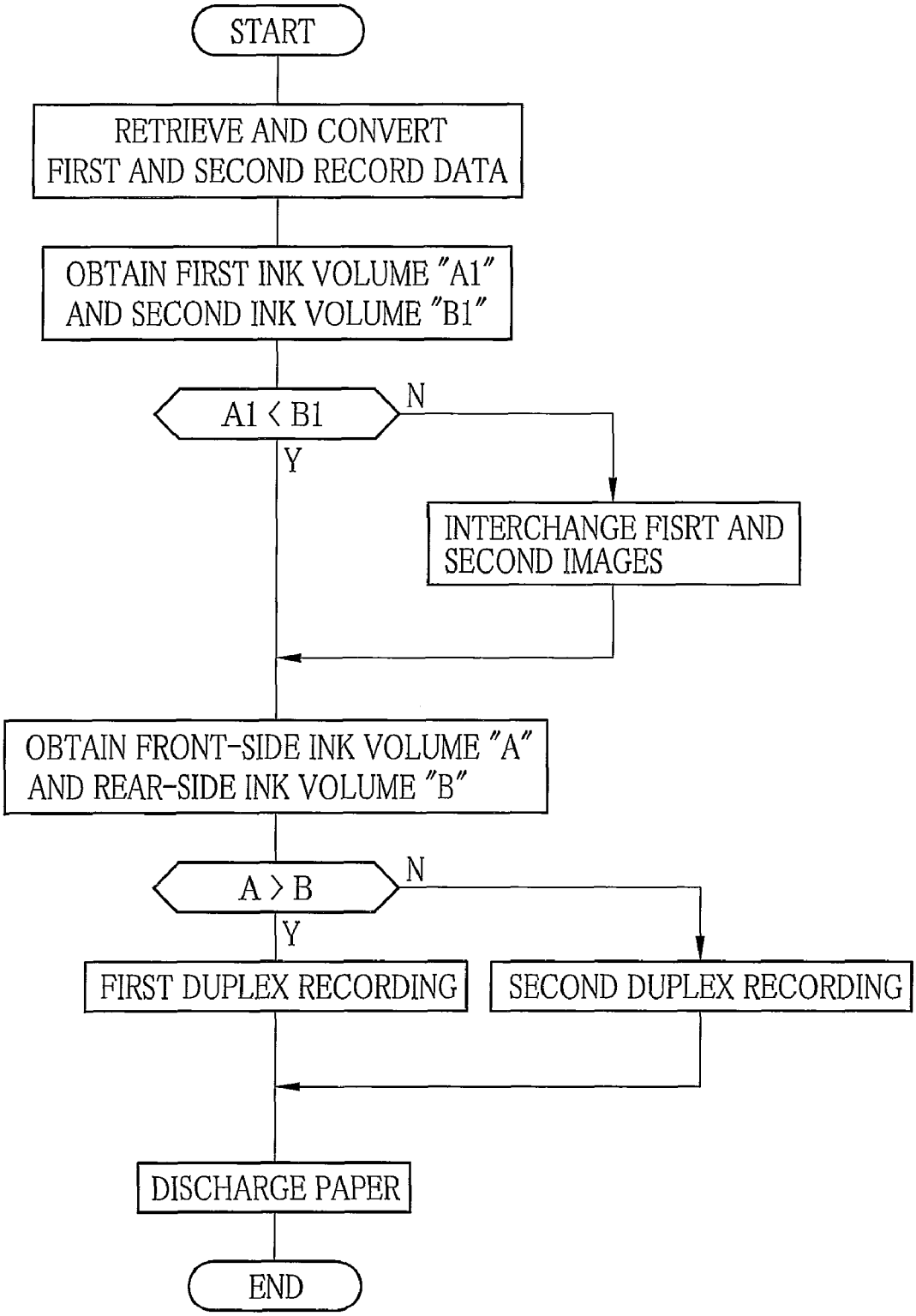
FIG. 13 is a flowchart of still another embodiment where the first and second images are switched according to a comparison result of ink droplets.

As shown in a flowchart of FIG. 13, before starting the duplex recording, the gate array 51 retrieves the first and second record data, which are then converted into the drive data in the data conversion circuit 65, and stored in the DRAM 50. The ink volume obtaining circuit 66 obtains first ink volume A1 for the first image 69 and second ink volume B1 for the second image 76. The record controller 72 compares the first ink volume A1 to the second ink volume B1.

When the first ink volume A1 is less than the second ink volume B1, the first image 69 is recorded on the first surface 3*a*, and the second image 76 is recorded on the second surface 3*b*. As with the first and second embodiments, it is preferred in this case to change the recording direction or the paper feed direction, based on the front-side ink volume A and the rear-side ink volume B of the first image 69.

When the first ink volume A1 is more than the second ink volume B1, the first image 69 is interchanged with the second image 76, so that the second image 76 is recorded on the first surface 3*a*, and the first image 69 is recorded on the second surface 3*b*. Again, it is preferred to turn the image upside down or change the paper feed direction, based on the front-side ink volume A and the rear-side ink volume B of the second image 76.

By interchanging the first image 69 and the second image 76 depending on the ink volume, the first surface 3*a* is always recorded with the image having less ink volume. When compared to the case not to interchange the first image 69 and the second image 76, the drying time for the first surface 3*a* is shortened, and thus the total time of duplex recording is reduced.

While the above embodiments are directed to compare the ink volume between the front half region 69*a* and the rear half region 69*b*, it may be possible to compare the size of a high-density area having the maximum volume of ink droplets between the two regions. This high-density area is, for example, the area whose ink volume per unit area exceeds a predetermined value. In view of the nature of the ink that dries slow as it is deposited intensively, this enables setting the drying time more appropriately.

In recording the rear half region in the first place, it is preferred to establish a threshold value beyond which reduction of the drying time produces an effect. When the difference of the front side ink volume and the rear side ink volume is below the threshold value, the front half region is recorded in the first place as normal, without turning the image upside down. A threshold value may also be established in the case of interchanging the first and second images.

Although the above embodiments are directed to a serial ink jet recording apparatus that moves the ink jet head in the main scanning direction, the present invention is also applicable to a line ink jet recording apparatus that use an elongated ink jet head to correspond to the width of the recording paper.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. An ink jet recording apparatus for ejecting droplets of ink to record a first image on a first surface of a recording medium being fed, and for reversing said recording medium back to front after said ink on said first surface has dried, and for ejecting droplets of ink to record a second image on a second surface of said recording medium while feeding said recording medium again, said ink jet recording apparatus comprising:

an ink volume obtainer for dividing said first image into a front half region and a rear half region, and for obtaining front-side ink volume and rear-side ink volume which represent total volume of ink droplets necessary for recording said front and rear half regions, said front half region being recorded on a first half portion of said recording medium as said recording medium is fed in a normal direction, and said rear half region being recorded on a last half portion of said recording medium; and a record controller for comparing said front-side ink volume to said rear-side ink volume, and for recording one of said front and rear half regions having more said ink volume in the first place.

2. The ink jet recording apparatus of claim 1, wherein said record controller turns said first and second images 180 degrees when said rear-side ink volume is more than said front-side ink volume, and records said images on said first and second surfaces of said recording medium being fed in said normal direction.

3. The ink jet recording apparatus of claim 1, wherein said record controller feeds said recording medium in an opposite direction to said normal direction when said rear-side ink volume is more than said front-side ink volume, and records said first image on said first surface during feed.

4. The ink jet recording apparatus of claim 1, wherein said ink volume obtainer further obtains a first ink volume and a second ink volume which represent total volume of ink droplets necessary for recording said first and second images, and wherein said record controller compares said first ink volume to said second ink volume before recording to said first surface of said recording medium, and interchanges said first and second images when said first ink volume is more than said second ink volume.

5. The ink jet recording apparatus of claim 1 further comprising a drying time calculator for calculating time for said ink on said first surface to dry, based on said front-side ink volume and said rear-side ink volume.

6. A method of ink jet recording for ejecting droplets of ink to record a first image on a first surface of a recording medium being fed, and for reversing said recording medium back to front after said ink on said first surface has dried, and for ejecting droplets of ink to record a second image on a second surface of said recording medium while feeding said recording medium again, said method comprising steps of:

dividing said first image into a front half region and a rear half region, and for obtaining front-side ink volume and rear-side ink volume which represent total volume of ink droplets necessary for recording said half regions of said image, said front half region being recorded on a first half portion of said recording medium as said recording medium is fed in a normal direction, and said rear half region being recorded on a last half portion of said recording medium;

comparing said front-side ink volume to said rear-side ink volume; and recording one of said front and rear half regions having more said ink volume in the first place.

7. The method of ink jet recording of claim 6, wherein in said recording step, when said rear-side ink volume is more than said front-side ink volume, said recording medium is fed in said normal direction, and said first image is turned 180 degrees and recorded on said first surface of said recording medium during feed, and after reversing of said recording medium back to front, said recording medium is fed in said normal direction again, and said second image is turned 180 degrees and recorded on said second surface during feed.

8. The method of ink jet recording of claim 6, wherein in said recording step, when said rear-side ink volume is more than said front-side ink volume, said recording medium is fed in an opposite direction to said normal direction, and said first image is recorded on said first surface of said recording medium during feed, and after reversing of said recording medium back to front, said recording medium is fed in said normal direction, and said second image is recorded on said second surface during feed.

9. The method of ink jet recording of claim 6, further comprising steps of:

prior to said ink volume obtaining step, obtaining first ink volume and second ink volume which represent total volume of ink droplets necessary for recording said first and second images; and comparing said first ink volume to said second ink volume, and interchanging said first and second images when said first ink volume is more than said second ink volume.

10. The method of ink jet recording of claim 6, further comprising a step of:

calculating time for said ink on said first surface to dry, based on said front-side ink volume and said rear-side ink volume.

* * * * *